US012808151B2

(12) United States Patent
Loving

(10) Patent No.: US 12,808,151 B2
(45) Date of Patent: Nov. 24, 2026

(54) CRAWLER FRAME PLOW

(71) Applicant: Black Ridge Resources, LLC

(72) Inventor: Andrew Loving, Grays Knob, KY (US)

(73) Assignee: Black Ridge Resources, LLC

( * ) Notice: Subject to any disclaimer, the term of this patent is extended or adjusted under 35 U.S.C. 154(b) by 252 days.

(21) Appl. No.: 18/671,498

(22) Filed: May 22, 2024

(65) Prior Publication Data

US 2024/0392534 A1 Nov. 28, 2024

Related U.S. Application Data

(60) Provisional application No. 63/468,067, filed on May 22, 2023.

(51) Int. Cl.
*E02F 9/08* (2006.01)
*E02F 9/16* (2006.01)

(52) U.S. Cl.
CPC ..... *E02F 9/0858* (2013.01); *E02F 9/166* (2013.01)

(58) Field of Classification Search
CPC ..... E02F 9/0858; E02F 9/166; E02F 9/121; B62D 33/0617; B62D 33/0633
See application file for complete search history.

(56) References Cited

U.S. PATENT DOCUMENTS 1,992,702 A * 2/1935 Koop ..... B62D 55/0845 305/109
3,976,337 A 8/1976 Vaughn
4,177,869 A 12/1979 Crabiel
4,371,086 A * 2/1983 Sankey ..... E02F 9/121 212/253
5,725,292 A 3/1998 Keedy et al.
6,158,539 A * 12/2000 Isley ..... E02F 9/028 280/6.154
7,798,738 B2 9/2010 Kawamoto et al.
8,167,384 B2 5/2012 Tan
8,764,128 B2 7/2014 Nebergall et al.
(Continued)

FOREIGN PATENT DOCUMENTS

CN 110528618 A 12/2019
KR 20070018508 A 2/2007
(Continued)

OTHER PUBLICATIONS

Patent Cooperation Treaty (PCT), International Searching Authority, International Search Report and Written Opinion for PCT Application No. PCT/US2024/30548, International Filing Date: May 22, 2024; Date of Mailing: Sep. 5, 2024.

*Primary Examiner* — Jason S Morrow
(74) *Attorney, Agent, or Firm* — Luedeka Neely, P.C.

(57) ABSTRACT

A crawler frame plow for removing dirt and debris from a crawler frame of machinery having a rotating cab portion. The crawler frame plow includes an arm portion for securing the crawler frame plow to the machinery, a leg portion extending from a proximal end to a distal end with the arm portion secured to the leg portion between the proximal end and the distal end, a plow portion disposed adjacent the distal end of the leg portion. When the crawler frame plow is secured to the machinery, rotation of a cab portion of the machinery causes a corresponding rotation of the plow portion such that the plow portion is configured to remove dirt and debris from the crawler frame during operation of the excavator.

19 Claims, 5 Drawing Sheets

(56) References Cited

U.S. PATENT DOCUMENTS

| | | | |
|---|---|---|---|
| 8,833,871 | B2 | 9/2014 | Nebergall et al. |
| 2018/0027609 | A1 | 1/2018 | Kojima et al. |
| 2022/0161876 | A1 | 5/2022 | Christensen |

FOREIGN PATENT DOCUMENTS

| | | | | | |
|---|---|---|---|---|---|
| KR | 20130064986 | A | * | 6/2013 | ..... E02F 9/0858 |
| WO | 2008080306 | A1 | | 7/2008 | |
| WO | 2018169106 | A1 | | 9/2018 | |

* cited by examiner

CRAWLER FRAME PLOW

CROSS REFERENCE TO RELATED APPLICATION

This application claims priority to co-pending U.S. Provisional Application Ser. No. 63/468,067 filed May 22, 2023, entitled "Excavator Crawler Frame Plow." the entire contents of which being incorporated herein by reference.

FIELD

This disclosure relates to the field of heavy machinery such as excavators. More particularly, this disclosure relates to a plow device for removing dirt and debris from the crawler frame of the heavy machinery that includes an operator cab that rotates during operation of the machinery.

BACKGROUND

Many types of heavy machinery include a swing drive that divides the upper rotating parts of the machinery (e.g., the cab, boom, arm, bucket, etc. collectively referred to herein as the "cab portion") to the lower traveling parts of the machinery's undercarriage. Examples of such machinery include excavators, hydraulic shovels, and feller bunchers. The swing drive (also referred to as a "circle drive" but will be referred to herein as the "swing drive" for consistency) provides the necessary components for allowing the cab portion to rotate 360° around its center axis independently of any movement of the undercarriage. More specifically, the cab portion is rotatably secured to the crawler frame of the undercarriage via a swing bearing (also referred to as a "slew ring" but will be referred to herein as the swing bearing for consistency) Typically, the swing bearing generally includes an inner ring and an outer ring. The outer ring is fixed to the bottom surface of the cab portion using a first set of bolts while the inner ring is fixed to the crawler frame of the undercarriage using a second set of bolts. In operation, the outer ring is configured to rotate around the inner ring when the cab portion is rotated via the swing drive.

Protection of the undercarriage and swing drive components is a critical aspect of maintenance for these types of heavy machinery having a rotating cabin portion. For example, excavators are notorious for compacting dirt, debris, and other rubble on top of the crawler frame and/or around the swing bearing in a manner that negatively affects performance. Further, continued operation of the machinery without removal of the dirt and debris will often result in costly and frequent repairs to the swing bearing and other swing drive components.

Rubble and dirt deposition on the crawler frame of the undercarriage can happen any number of ways. For example, tracks kick up dirt and other material as an excavator traverses a site. Demolitions often require tearing structures down with pieces occasionally falling onto the excavator crawler frame. Similarly, mining operations involve blasting or other circumstances in which material may be inadvertently thrown onto the crawler frame.

Most often, manual removal is the only way to rid the crawler frame of dirt and rubble. This is disadvantageous for several reasons. First, it requires a crew member who would otherwise be actively working toward completing a job to instead perform the labor intensive and time-consuming task of shoveling material off the crawler frame. Second, for obvious safety reasons, the machinery cannot be used while the crew member is performing maintenance resulting in inefficient down time for the excavator.

Accordingly, there is a need for a device to remove dirt and debris from the crawler frame and around the swing bearing in an efficient and safe manner.

SUMMARY

The above and other needs are met by a crawler frame plow for removing dirt and debris from a crawler frame of machinery having a rotating cab portion. The crawler frame plow includes an arm portion for securing the crawler frame plow to the machinery, a leg portion extending from a proximal end to a distal end with the arm portion secured to the leg portion between the proximal end and the distal end, and a plow portion disposed adjacent the distal end of the leg portion. When the crawler frame plow is secured to the machinery, rotation of the rotating cab portion causes a corresponding rotation of the plow portion such that the plow portion is configured to remove dirt and debris from the crawler frame during operation of the machinery.

According to certain embodiments, the plow portion includes a rounded edge dimensioned and configured to substantially conform to an outer surface of an undercarriage frame portion of the machinery during rotation of the plow portion. In some embodiments, the plow portion includes a first side edge and an opposing second side edge with the rounded edge disposed between the first side edge and the opposing second side edge. According to some embodiments, the first side edge and opposing second side edge are angled inward with respect to the rounded edge.

According to certain embodiments, the plow portion is configured to be adjustably secured to the leg portion in a plurality of positions for adjusting a horizontal position of the plow portion. In some embodiments, the plow portion includes one or more slots for slidably receiving the leg portion in the plurality of positions along the length of the one or more slots.

According to certain embodiments, the leg portion is configured to receive the arm portion in a plurality of positions for adjusting a vertical position of the plow portion with respect to the arm portion. In some embodiments, the leg portion includes one or more slots for slidably receiving the arm portion in the plurality of positions along the length of the one or more slots.

According to certain embodiments, the arm portion includes one or more apertures positioned and configured to be aligned with one or more of a plurality of apertures of a swing bearing of the machinery for removably attaching the crawler frame plow to the machinery using the plurality of apertures of the swing bearing. In some embodiments, the one or more apertures of the arm portion are in the form of one or more slots for adjustably aligning with different bolt patterns for the one or more of the plurality of apertures of the swing bearing.

According to another embodiment of the disclosure, a heavy equipment machinery system includes a rotating cab portion, an undercarriage portion having a crawler frame, a swing drive for connecting the rotating cab portion to the undercarriage portion such that the rotating cab portion is operable to rotate independently of movement of the undercarriage portion, and a crawler frame plow operatively connected to the rotating cab portion such that the crawler frame plow is positioned adjacent the crawler frame and the crawler frame plow rotates simultaneously with the rotating cab portion for removing dirt and debris from the crawler frame.

According to certain embodiments, the undercarriage portion includes an undercarriage frame portion and the crawler frame plow includes a rounded edge dimensioned and configured to substantially conform to an outer surface of the undercarriage frame portion.

According to certain embodiments, the crawler frame plow includes an arm portion for operatively connecting the crawler frame plow to the rotating cab portion, a leg portion extending from a proximal end to a distal end with the arm portion secured to the leg portion between the proximal end and the distal end, and a plow portion disposed adjacent the distal end of the leg portion. In some embodiments, the swing drive includes a swing bearing having an outer ring secured to the rotating cab portion using a plurality of bolts, and wherein the arm portion operatively connects the crawler frame plow to the rotating cab portion using one or more of the plurality of bolts.

According to another embodiment of the disclosure, a method for removing dirt and debris from a crawler frame of machinery having a rotating cab portion includes: providing a crawler frame plow having a plow portion; securing the crawler frame plow to a rotating component of the machinery such that the plow portion is disposed adjacent the crawler frame; and rotating the rotating component of the machinery such that the crawler frame plow rotates around a swing drive of the machinery simultaneously with the rotating component and the plow portion removes dirt and debris from the crawler frame during rotation of the crawler frame plow.

BRIEF DESCRIPTION OF THE DRAWINGS

Further advantages of the disclosure are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 3:
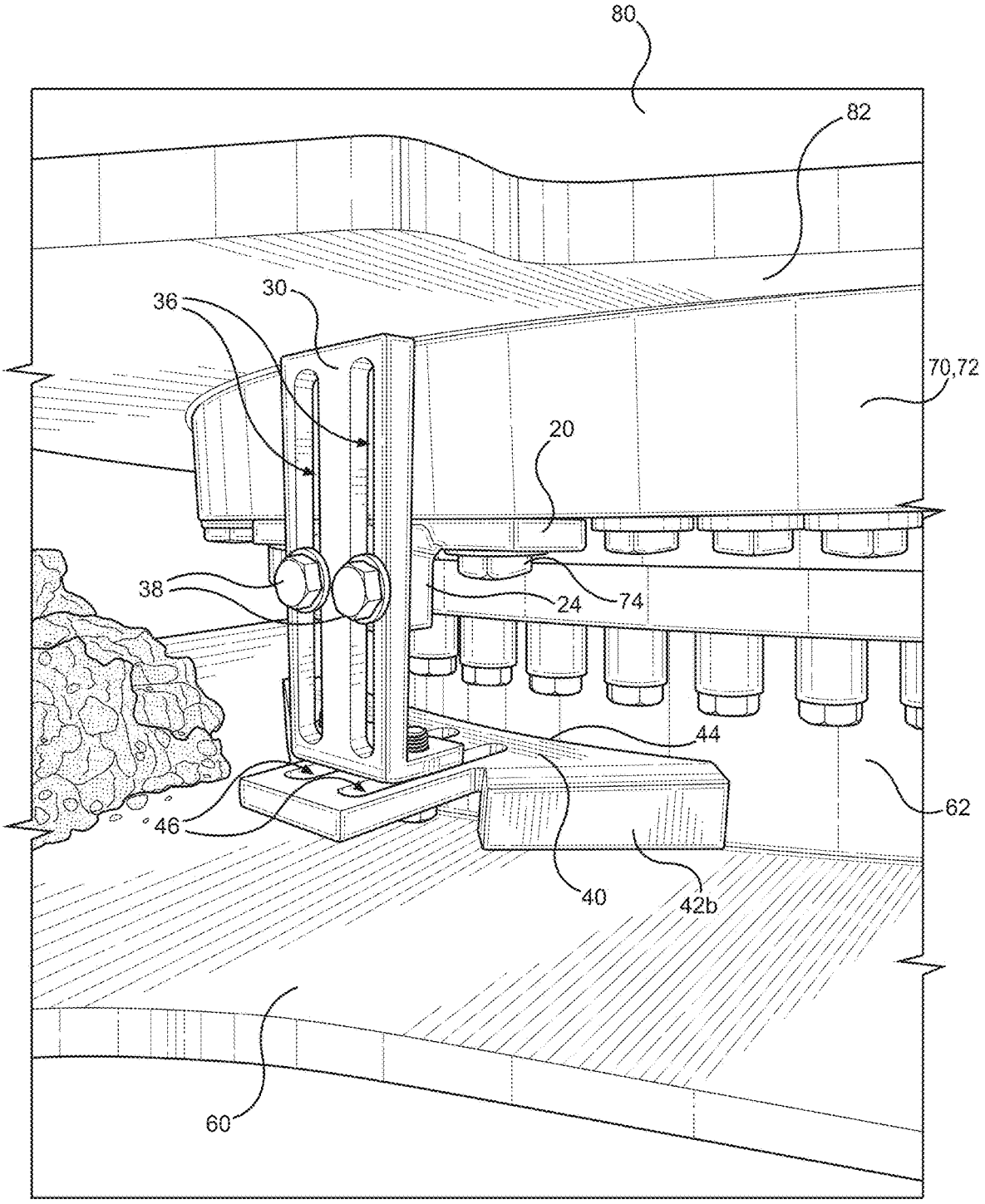
FIG. 3 depicts an excavator crawler frame plow as secured to a bottom surface of a cab portion of an excavator via the swing bearing according to one embodiment of the disclosure.
Figure 4:
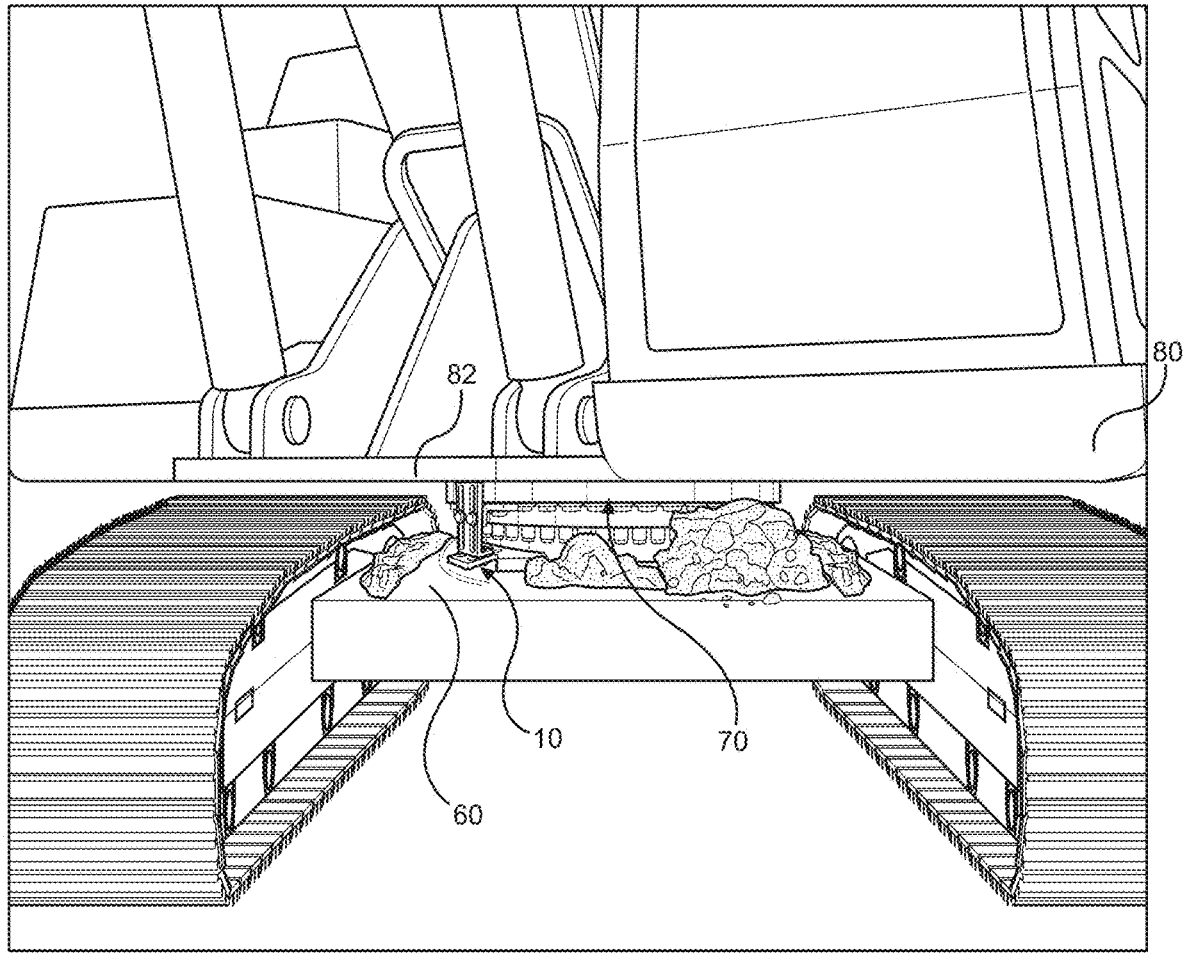
FIGS. 4-5 depict an excavator crawler frame plow in operation to remove dirt and debris from the crawler frame of an excavator during rotation of the cab portion according to one embodiment of the disclosure.
Figure 5:
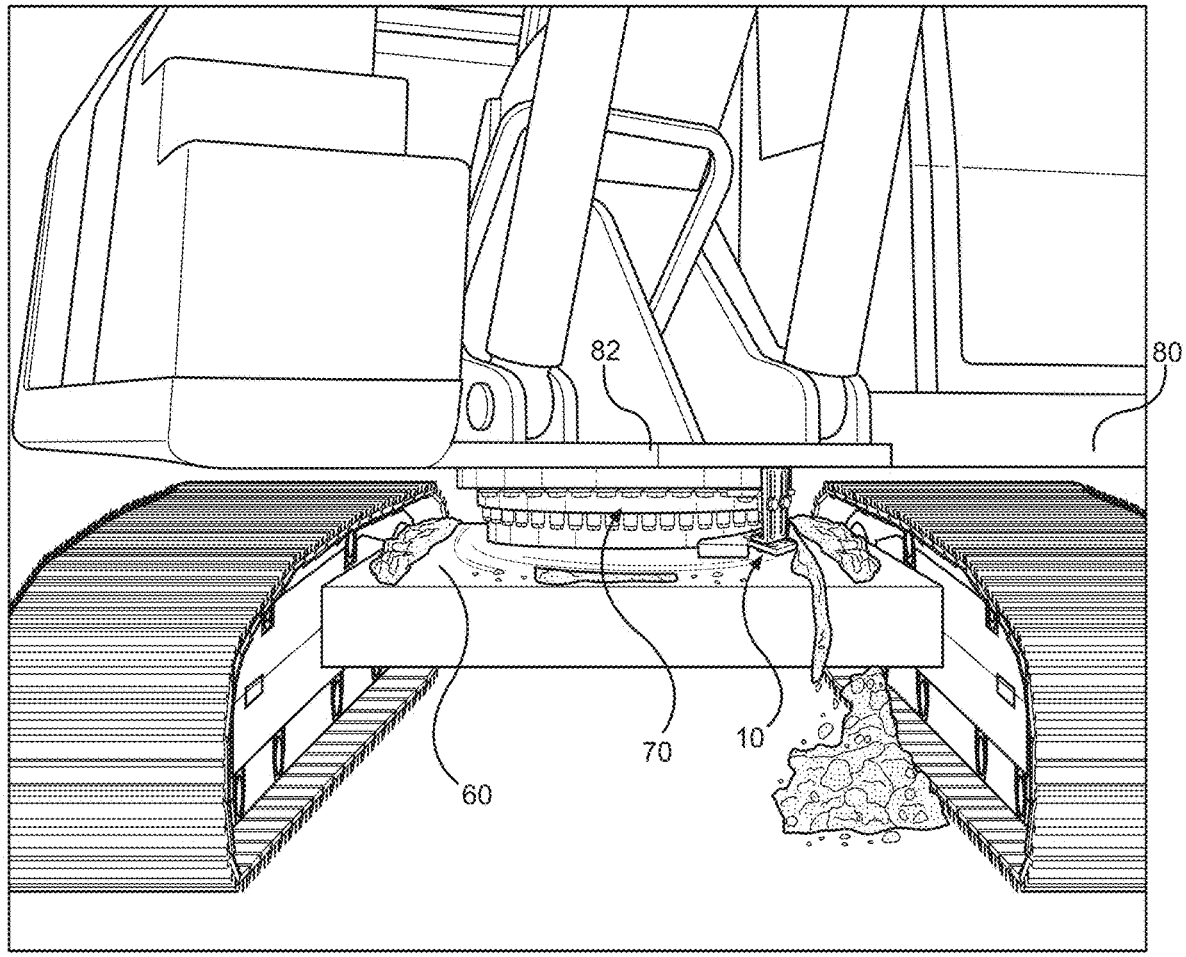

With reference initially to FIGS. 4-5, a crawler frame plow 10 is depicted according to one embodiment of the present disclosure. While the crawler frame plow 10 is depicted herein as installed on an excavator, the plow can be similarly used or otherwise implemented with other types of heavy machinery having a rotating cab portion connected to an undercarriage using a swing drive. The crawler frame plow 10 may take many different forms, shapes, sizes, etc. within the teachings of the present disclosure. However, the plow 10 is generally dimensioned and configured to be secured to machinery such that it rotates to remove dirt and debris from the crawler frame 60 and the swing drive components 70 simultaneously with rotation of the cab portion 80. More specifically, the plow 10 is generally designed to be attached or otherwise mounted to an existing rotating component of the machinery such that the plow 10 automatically rotates around the crawler frame 60 as the cab portion 80 is rotated to clear to move as much material away from the crawler frame 60 and swing drive components 70 as efficiently as possible. The rotating component of the machinery in which the plow 10 is secured could vary depending on the specific manufacturer and/or design of the machinery. For example, in certain embodiments, the plow 10 could be secured directly to the bottom surface 82 of the cab portion 80 such that it rotates with rotation of the cab. In other embodiments, the plow 10 could be secured directly to the swing bearing 70. However, in another embodiment (and as best shown in FIG. 3 and as described below), the plow 10 is secured to the cab portion 80 via the rotating outer ring of the swing bearing 70.

According to some embodiments, the crawler frame plow 10 could be provided as a removable add-on feature. In other embodiments, the plow 10 could be incorporated as a standard part of the excavator by the manufacturer. While the plow 10 may be formed of many different types of materials, the plow 10 is preferably formed from stainless steel or other similar materials with like suitable properties.

With reference back to FIGS. 1-3, the exemplary embodiment of the plow 10 of the present disclosure includes an arm portion 20 for connecting the plow 10 to the machinery, a plow portion 40 for removing dirt and debris from the crawler frame 60 of the machinery, and a leg portion 30 for positioning the plow portion 40 as desired with respect to the crawler frame 60 and/or swing bearing 72. In preferred embodiments, the arm portion 20, leg portion 30, and plow portion 40 are adjustably joined as separate components as shown herein and described below. However, alternate embodiments could include two or more of the arm portion 20, leg portion 30, and plow portion 40 formed as unitary structures and/or as components welded to each other. Further, as noted above, the plow 10 and its corresponding components could be incorporated into many different sizes and shapes depending on the machinery in which the plow 10 is intended to be used, different operating conditions, operator preferences, etc. Similarly, in embodiments in which the plow 10 is removable from the machinery, different sized and dimensioned plows 10 could be interchangeable such that different plows 10 could be used as needed or desired.

As noted above, the arm portion 20 is used to connect the plow 10 to the machinery. While the arm portion 20 may take various configurations depending on the manner the plow 10 is intended to be secured to the machinery or the type of machinery in which the plow 10 is intended to be secured, the arm portion 20 of this embodiment preferably includes a substantially horizontal plate having one or more apertures 22 disposed therein as shown best in FIG. 2. With reference to FIG. 3, to connect the plow 10 to the excavator according to this embodiment, one or more bolts 74 are removed from the outer ring 72 of the swing bearing 70 of the excavator. The arm portion 20 is then positioned such that the one or more apertures 22 of the arm portion 20 are aligned with the apertures of the swing bearing 70 in which bolts 74 were removed. With the appropriate apertures aligned, the bolts 74 are inserted through the one or more apertures 22 of the arm portion 20 and the apertures of the outer ring 72 of swing bearing 70 until fastened to the lower frame 82 of the cab portion 80 to secure the plow 10 to the excavator. In other words, bolts 74 are connected to the lower frame 82 of the excavator as generally known in the art to connect the swing bearing 70 to the lower frame 82 except bolts 74 are first passed through the appropriately positioned apertures 22 of the arm portion to secure the plow 10 to the excavator. In this manner, the plow 10 rotates simultaneously with the cab portion 80 and the swing bearing 70 during operation of the excavator.

Figure 2:
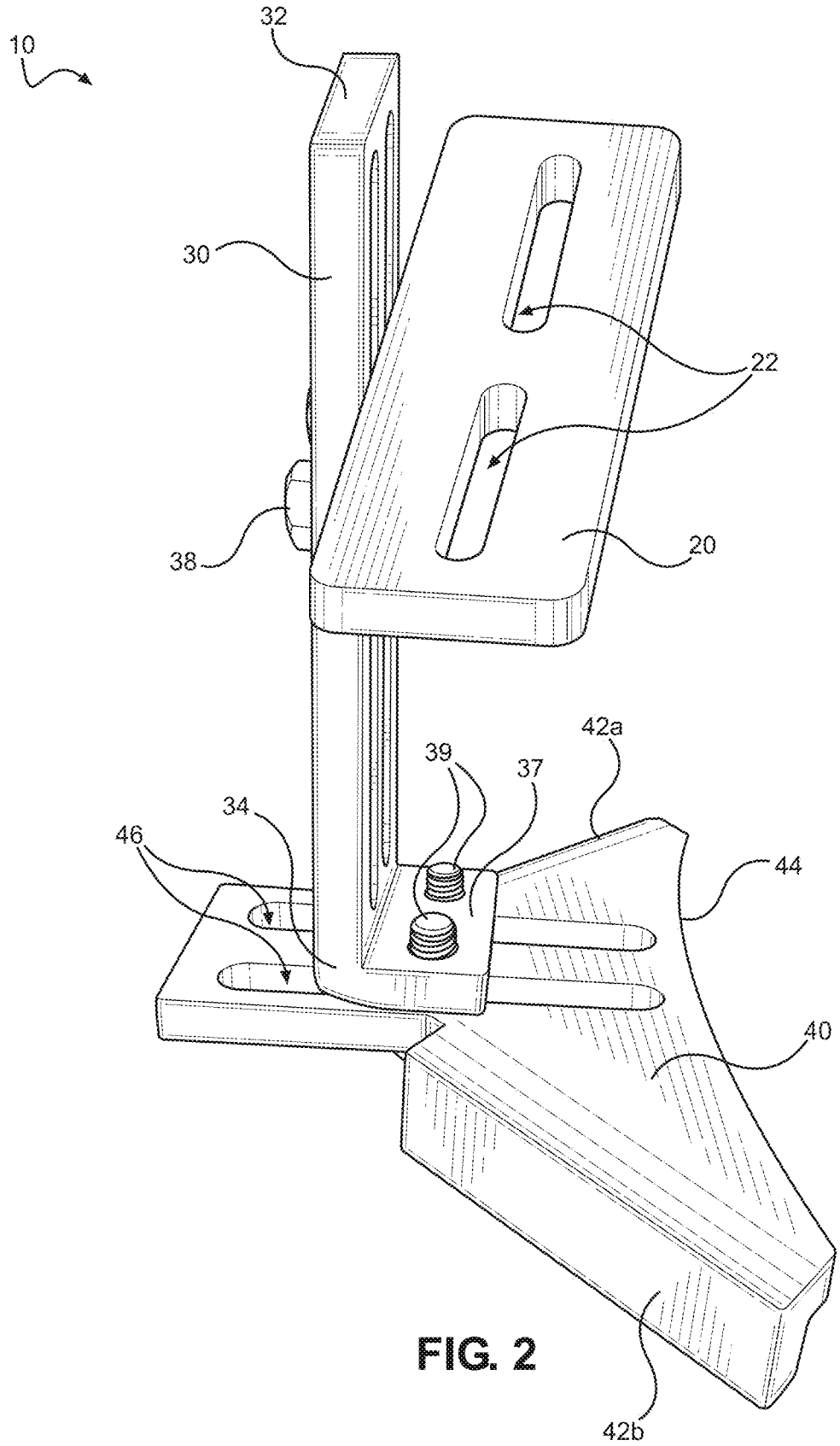
FIG. 2 depicts a side perspective view of the excavator crawler frame plow according to one embodiment of the disclosure.

In preferred embodiments, and as shown best in FIG. 2, the one or more apertures 22 of the arm portion 20 are in the form of one or more slots. The slots allow for adjustability with respect to the bolt pattern/spacing of bolts 74 for different machinery.

Figure 1:
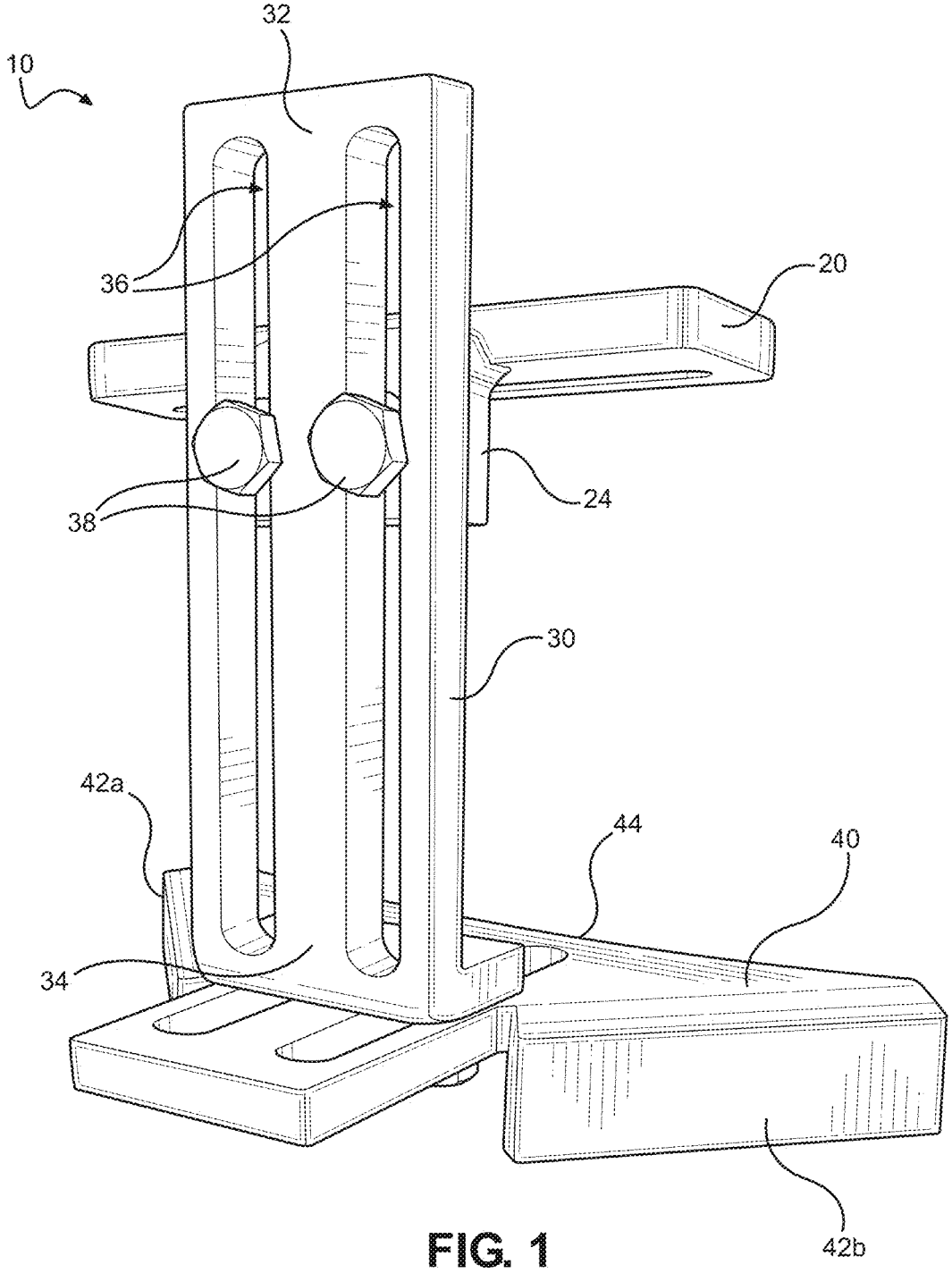
FIG. 1 depicts a front perspective view of an excavator crawler frame plow according to one embodiment of the disclosure.

With reference to FIGS. 1-3, the leg portion 30 of this embodiment is a substantially vertically oriented plate that includes a proximal end 32 and a distal end 34. The plow portion 40 is connected to the leg portion 30 adjacent the distal end 34 and the arm portion 20 is connected to the leg portion 30 above the plow portion 40 between the proximal end 32 and the distal end 34.

In preferred embodiments, the positioning of the arm portion 20 along the length of leg portion 30 is adjustable. For example, as shown best in FIG. 1, the leg portion 30 includes one or more slots 36 running along the length of the leg portion 30 generally from the proximal end 32 to the distal end 34. Bolts or fasteners 38 may then be inserted through the slots 36 and into the arm portion 20 (such as in flange 24 of arm portion 20) for securing the arm portion 20 at a desired vertical position with respect to the leg portion 30. Thus, with reference to FIG. 3, the positioning of the arm portion 20 along the length of the leg portion 30 may be adjusted as needed/desired based on the dimensions of the swing bearing 70 and desired position of the plow portion 40 with respect to crawler frame 60.

With respect to the plow portion 40, it can take many different forms but preferably includes at least two side edges 42*a* and 42*b* dimensioned and configured for pushing dirt and debris off the crawler frame 60. Disposed between the side edges 42*a* and 42*b* is preferably a rounded edge 44 that is dimensioned and configured to substantially conform to the curvature of the undercarriage frame portion 62 in which the inner ring (not shown) of the swing bearing 70 is secured. The angled edges 42*a* and 42*b* are preferably angled inward towards each other with respect to rounded edge 44 for directing dirt and debris away from the undercarriage frame portion 62 as the plow 10 rotates around the crawler frame 60 with cab portion 80.

According to preferred embodiments, and as best shown in FIG. 2, the plow portion 40 is also adjustable horizontally with respect to the leg portion 30. According to this embodiment, the plow portion includes one or more slots 46 extending away from the rounded edge 44. The leg portion 30 then includes a flange portion 37 for connecting the plow portion 40 to the leg portion 30 using bolts/fasteners 39 at a desired position along the length of the slots 46.

As explained herein, the crawler frame plow 10 of the present disclosure eliminates or otherwise reduces the need for regular manual removal of material from the crawler frame 60 of an excavator or other type of heavy machinery that includes a rotating cab portion. Using the crawler frame plow 10, an operator can operate the machinery using all of its normal functions as well as keep dirt and rubble from compacting around the crawler frame 60 and swing drive components 70. This increases efficiency by both minimizing manpower required to maintain the machinery while also minimizing machinery downtime, allowing teams to finish jobs more quickly under harsher conditions. In operation, and as exemplified in FIGS. 4-5, an operator maneuvers the cab portion 80 of the machinery to rotate which in turn functions to rotate the plow 10 for removing dirt and debris accumulated on the crawler frame 60. Thus, an operator can both keep the crawler frame 60 clean of debris and accomplish normal tasks using the machinery.

The foregoing description of preferred embodiments for this disclosure have been presented for purposes of illustration and description. They are not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by any claims when interpreted in accordance with the breadth to which they are fairly, legally, and equitably entitled.

What is claimed is:

1. A crawler frame plow for removing dirt and debris from a crawler frame of machinery having a rotating cab portion, the crawler frame plow comprising:

an arm portion for securing the crawler frame plow to the machinery;

a leg portion extending from a proximal end to a distal end with the arm portion secured to the leg portion between the proximal end and the distal end; and a plow portion disposed adjacent the distal end of the leg portion, the plow portion including a rounded edge dimensioned and configured to substantially conform to an outer surface of an undercarriage frame portion of the machinery, wherein, when the crawler frame plow is secured to the machinery, rotation of the rotating cab portion causes a corresponding rotation of the plow portion such that the plow portion is configured to remove dirt and debris from the crawler frame during operation of the machinery.

2. The crawler frame plow of claim 1 wherein the plow portion includes a first side edge and an opposing second side edge, the rounded edge disposed between the first side edge and the opposing second side edge.

3. The crawler frame plow of claim 2 wherein the first side edge and opposing second side edge are angled inward with respect to the rounded edge.

4. The crawler frame plow of claim 1 wherein the plow portion is configured to be adjustably secured to the leg portion in a plurality of positions for adjusting a horizontal position of the plow portion.

5. The crawler frame plow of claim 4 wherein the plow portion includes one or more slots for slidably receiving the leg portion in the plurality of positions along the length of the one or more slots.

6. The crawler frame plow of claim 1 wherein the leg portion is configured to receive the arm portion in a plurality of positions for adjusting a vertical position of the plow portion with respect to the arm portion.

7. The crawler frame plow of claim 6 wherein the leg portion includes one or more slots for slidably receiving the arm portion in the plurality of positions along the length of the one or more slots.

8. The crawler frame plow of claim 1 wherein the arm portion includes one or more apertures positioned and configured to be aligned with one or more of a plurality of apertures of a swing bearing of the machinery for removably attaching the crawler frame plow to the machinery using the plurality of apertures of the swing bearing.

9. The crawler frame plow of claim 8 wherein the one or more apertures of the arm portion are in the form of one or more slots for adjustably aligning with different bolt patterns for the one or more of the plurality of apertures of the swing bearing.

10. A heavy equipment machinery system comprising:

a rotating cab portion;

an undercarriage portion having a crawler frame;

a swing drive for connecting the rotating cab portion to the undercarriage portion such that the rotating cab portion is operable to rotate independently of movement of the undercarriage portion, the swing drive including a swing bearing having an outer ring secured to the rotating cab portion using a plurality of bolts; and a crawler frame plow operatively connected to the rotating cab portion such that the crawler frame plow is positioned adjacent the crawler frame and the crawler frame plow rotates simultaneously with the rotating cab portion for removing dirt and debris from the crawler frame, the crawler frame plow including an arm portion for operatively connecting the crawler frame plow to the rotating cab portion using the plurality of bolts, a leg portion extending from a proximal end to a distal end with the arm portion secured to the leg portion between the proximal end and the distal end, and a plow portion disposed adjacent the distal end of the leg portion.

11. The heavy equipment machinery system of claim 10 wherein the undercarriage portion includes an undercarriage frame portion and the crawler frame plow includes a rounded edge dimensioned and configured to substantially conform to an outer surface of the undercarriage frame portion.

12. A crawler frame plow for removing dirt and debris from a crawler frame of machinery having a rotating cab portion, the crawler frame plow comprising:

an arm portion for securing the crawler frame plow to the machinery;

a leg portion extending from a proximal end to a distal end with the arm portion secured to the leg portion between the proximal end and the distal end; and a plow portion disposed adjacent the distal end of the leg portion, wherein the leg portion is configured to receive the arm portion in a plurality of positions for adjusting a vertical position of the plow portion with respect to the arm portion, and wherein, when the crawler frame plow is secured to the machinery, rotation of the rotating cab portion causes a corresponding rotation of the plow portion such that the plow portion is configured to remove dirt and debris from the crawler frame during operation of the machinery.

13. The crawler frame plow of claim 12 wherein the leg portion includes one or more slots for slidably receiving the arm portion in the plurality of positions along the length of the one or more slots.

14. The crawler frame plow of claim 12 wherein the plow portion includes a rounded edge dimensioned and configured to substantially conform to an outer surface of an undercarriage frame portion of the machinery during rotation of the plow portion.

15. The crawler frame plow of claim 14 wherein the plow portion includes a first side edge and an opposing second side edge, the rounded edge disposed between the first side edge and the opposing second side edge, and the first side edge and opposing second side edge are angled inward with respect to the rounded edge.

16. The crawler frame plow of claim 12 wherein the plow portion is configured to be adjustably secured to the leg portion in a plurality of positions for adjusting a horizontal position of the plow portion.

17. The crawler frame plow of claim 16 wherein the plow portion includes one or more slots for slidably receiving the leg portion in the plurality of positions along the length of the one or more slots.

18. The crawler frame plow of claim 12 wherein the arm portion includes one or more apertures positioned and configured to be aligned with one or more of a plurality of apertures of a swing bearing of the machinery for removably attaching the crawler frame plow to the machinery using the plurality of apertures of the swing bearing.

19. The crawler frame plow of claim 18 wherein the one or more apertures of the arm portion are in the form of one or more slots for adjustably aligning with different bolt patterns for the one or more of the plurality of apertures of the swing bearing.

* * * * *